United States Patent [19]

Kaneko et al.

[11] Patent Number: 4,885,222

[45] Date of Patent: Dec. 5, 1989

[54] METHOD FOR DEVELOPING ELECTROSTATIC LATENT IMAGE IN AN OSCILLATING ELECTRIC FIELD

[75] Inventors: Tadashi Kaneko; Meizo Shirose; Yoko Yamamoto, all of Hachioji, Japan

[73] Assignee: Konica Corporation, Tokyo, Japan

[21] Appl. No.: 221,298

[22] Filed: Jul. 19, 1988

[30] Foreign Application Priority Data

Jul. 21, 1987 [JP] Japan ..... 62-180127

[51] Int. Cl.[4] ..... G03G 13/09

[52] U.S. Cl. ..... 430/102; 430/111; 430/122

[58] Field of Search ..... 430/102, 111, 122

[56] References Cited

U.S. PATENT DOCUMENTS 4,258,116 3/1981 Takasa et al. ..... 430/102
4,414,321 11/1983 Miyakawa et al. ..... 430/111 X
4,792,512 12/1988 Haneda et al. ..... 430/102

FOREIGN PATENT DOCUMENTS 1134130 10/1982 Canada ..... 430/111
54-108634 8/1979 Japan ..... 430/122

*Primary Examiner*—Roland E. Martin
*Attorney, Agent, or Firm*—Jordan B. Bierman

[57] ABSTRACT

A method for developing an electrostatic latent image comprising, a step of supplying a developer containing a carrier and a toner, said toner consisting of fine toner particles of which not less than 95% by weight have a particle size of from 1/1.7 to 1.7 times as large as the weight average size of the toner particles ($D_{50}$), to the outer circumfence of a cylinder-shaped sleeve member of a developer transporting means, a step of forming a thin layer of said developer on the surface of said sleeve member by the use of a layer thickness regulating member so that the maximum thickness of the developer layer is smaller than the minimum distance between the surface of said sleeve member and the surface of said electrostatic latent image carrying member, a step of carrying said developer to close proximity of the electrostatic latent image formed on said electrostatic larent image carrying member, and a step of forming a toner image on said electrostatic latent image carrying member is disclosed.

10 Claims, 2 Drawing Sheets

METHOD FOR DEVELOPING ELECTROSTATIC LATENT IMAGE IN AN OSCILLATING ELECTRIC FIELD

FIELD OF THE INVENTION

The present invention relates to a method for developing electrostatic latent images, and more particularly to a developing method in which a thin developer layer consisting of a two-component developer comprised of a toner and a carrier is formed on a developer transport carrier by using a layer thickness regulating member, this developer layer is transported on its surface keeping out of contact with the latent image carrier, to the developing region, and an electrostatic latent image formed on the latent image carrier is then developed by the developer, under application of an oscillating electric field.

BACKGROUND OF THE INVENTION

At present, for the formation of visible images from certain image information, those methods for image forming through electrostatic latent images as in the electrophotographic process, electrostatic recording process, electrostatic printing process, and the like, are commonly used.

As the developer for use in making electrostatic latent image development there are known two types, i.e., a two component type developer comprised of a mixture of a toner and a carrier, and a one component type developer comprised of a magnetic material containing magnetic toner to be used alone without being mixed with any carrier. In an electrostatic latent image developing method which uses the former two component type developer, the toner of the developer is frictionally chargeable by mechanically stirring the mixture of it with toner carrier, so that by making an appropriate selection of the properties of the carrier and stirring condition, the polarity of the toner by charging and the amount of charge can be controlled to a considerable degree, and the developer is excellent in the developability as well as in the fluidity, and, moreover, colors, when provided to the toner are widely selectable. In this respect, the electrostatic latent image developing method using a two component type developer is considered more advantageous than that of the latter using a one-component-type developer.

Conventionally known electrostatic image developing methods which use the two-component developer are classified into two types: (1) A contact-type developing method, in which development takes place with a developer layer in direct contact with the surface of the latent image carrier, and (2) a non contact type developing method, in which a developer layer is transported, whith its surface keeping out of contact with the latent image carrier, into a developing space, and an oscillating electric field is applied to the developer layer to perform development.

According to the latter non contact type developing method, the developer layer does not come into direct contact with the latent image carrier, so that it is advantageous particularly in the multicolor image formation. That is, after forming a first color toner image on the latent image carrier, with this toner image remaining intact without being transferred, charging/exposure and developing processes for a second color are carried out, whereby the second color toner image can be superposedly formed on the first color toner image.

Accordingly, it is possible to form a multicolor image easily with no need of any complex construction such as a transfer drum.

As has been mentioned above, the developing method using a two-component developer in non-contact manner in an oscillating electric field has the advantage that the developer used is satisfactory in the fluidity as well as in the frictional chargeability and excellent in the developability, and besides the selectable range of colors applicable to the toner is so wide as suitable for color copying.

In the non contact type developing method, the developing is made by flying the toner of the developer layer toward the latent image carrier, so that an oscillating electric field strong enought to fly the toner is required in the developing gap d between the latent image carrier and the developing sleeve.

The strength E of such the oscillating electric field is normally from 500 to 10,000 V/mm: the oscillating electric field, if less than 500 V/mm, is too weak to fly toner, while if more than 10,000 V/mm, is to cause a dielectric breakdown. The oscillating electric field is formed by applying an AC voltage V to the gap d between the latent image carrier and the developing sleeve, and their relationship is expressed by the formula: $E=V/d(mm)$. If the AC voltage V in the formula comes to excess, a leak discharge is prone to occur between the developing sleeve surface and peripheral devices, inviting danger, resulting in the damage of devices or fall of bias voltage. For this reason, the foregoing AC voltage V is conventionally less than 10 KV(p—p), the developing gap d in the above formula therefore is not more than 1 mm, and the thickness of the developer layer to be transported into the developing gap d is not more than 1 mm, and more preferably not more than 0.5 mm.

There have been a number of proposals for means to obtain such a thin developer layer. For example, Japanese Utility Model Publication Open to Public Inspection (hereinafter referred to as Japanese Utility Model O.P.I. Publication) Nos. 96455/1981, 104754/1981 and 112352/1982 and Japanese Patent Publication Open to Public Inspection (hereinafter referred to as Japanese Patent O.P.I. Publication) No. 143650/1979 disclose a thin layer forming member having a doctor blade provided close by the sleeve surface for regulating the developer layer, in which improvement is made on the doctor blade's form and arrangement in angle to the developing sleeve, material, and the like. Also, Japanese Utility Model O.P.I. Publication No. 57866/1983 and Japanese Patent 0.P.I. Publication No. 114561/1984 propose a thin layer forming member having a magnetic blade. Japanese Utility Model O.P.I. Publication No. 86654/1983 discloses one having a sponge press on the developing sleeve to regulate the thickness of the developer layer. And Japanese Patent O.P.I. Publication No. 126567/1984 describes the use of an elastic roll to press on the sleeve surface to regulate the thickness of the developer layer.

As has been explained, various types of thin layer forming member have been proposed to date, but the layer's thickness control is not easy, tending to cause uneven thickness, which has made it difficult to steadily obtain a uniform thickness-having thin developer layer. This problem is significant particularly in the case of using a two-component developer comprising a carrier and a toner, both being different in the particle size, configuration, fluidity and other physical properties.

We had earlier proposed in our Patent Application No. 192710/1987 (Japanese Patent O.P.I. Publication No. 52566/1987) a thin layer forming member having an elastic plate to press on the developing sleeve surface to form a thin two-component developer layer. This thin layer forming member, unlike those conventional ones utilizing a fixed narrow gap, allows a wide-range elastic regulation of the layer thickness, thus enabling not only to make a reasonable layer thickness regulating operation but also to obtain uniformly, stably an even thinner developer layer. This is advantageous especially in the case where a two-component developer is used; if the above-mentioned elastic plate is arranged so as to press against the sleeve surface with a pressure allowing the passage of about 1 to 3 carrier particles, then a so thin layer in the thickness range around the carrier particle size can be easily obtained. Furthermore this is advantageous in respect that it obstructs the passage of aggregates or foreign matter contained in the developer and allows the passage of the developer layer alone.

The (a) and (b) of FIG. 1 are drawings for explaining the particular construction of a thin layer forming member which uses an elastic plate, wherein 1 is a developing sleeve which rotates in the direction of arrow, 2 is a magnetic roll having a plurality of alternate N and S polarities, 3 is a thin layer forming member consisting of an elastic plate, and 4 is a support for supporting the elastic plate 3. When the planar elastic plate 3, with its tip end facing upstream the rotating direction of the developing sleeve, presses on the surface of developing sleeve 1, a wedge-shaped space 5 is formed between the tip end and the pressed contact point. When, under this condition, developing sleeve 1 is moved in a given direction, developer D that is retained on developing sleeve 1 due to the magnetic field of magnetic roll 2 is separated into two parts: one getting into wedge-shaped space 5 and the other having failed to get into wedge-shaped space 5 and sent away toward the reverse side of elastic plate 3 opposite to developing sleeve 1, and of these parts only the developer D that has entered the wedge-shaped space passes, due to the frictional force with developing sleeve 1, through the gap between developing sleeve 1 and elastic plate 3, and then is transported to the developing region. In this instance, the amount of the developer that is allowed to pass between developing sleeve 1 and elastic plate 3 corresponds to the gap $\epsilon$, but is determined according to the height h of the opening of wedge-shaped space 5, free length 1, pressing force $\sigma$, and the like, and usually, the height h of the opening is from 0.08 to 0.3 mm, free length l is from 1 to 3 mm, and pressing force $\sigma$ is from 1 to 6 g/mm.

Thus, the gap $\epsilon$ between developing sleeve 1 and elastic plate 3 allows the passage of an amount of one to several particles of carrier, resulting in the formation of a thin developer layer with a thickness of not more than 500 $\mu$m, and preferably 10 to 300 $\mu$m. By using the thin layer forming member having an elastic plate of the above construction, a thin two-component developer layer having a uniform thickness can be stably obtained. Therefore, this has the advantage that non-contact development with its carrier restrained from flying can be carried out and an image excellent in the resolution can be obtained. As a result of making the developer layer a thin layer as above-mentioned, the developing gap d is allowed to be small, thus making so much the smaller the oscillating electric field and AC voltage for forming the oscillating electric field, so that the development can be carried out with no dielectric breakdown, leak discharge, etc.

Incidentally, when non-contact development is made in the oscillating electric field, if the mass of the toner on the sleeve is regarded as M and the quantity of charge as Q, there is a tendency that the smaller the Q/M, the more easily does the development take place.

Since there is a nearly inversely proportional relation between the above Q/M and the particle size of the toner, relatively large particle sizes-having toner is much more consumed and smaller particle sizes-having toner remains: thus bringing about a phenomenon called 'selective development'. Accordingly, when the non-contact development is repeatedly continued, smaller particle size toner is accumulated in the developer inside the developing device to cause the carrier surfce to have lots of small particle-size toner attached thereto, bringing about such troubles as 1) fatigue/deterioration of the carrier, 2) inadequate frictional charging of the toner, 3) lowering of image density, and 4) scattering of the toner. The reason why such troubles occur is considered due to the fact that the increase in the amount of the small particle-size toner increases the surface area of the toner, causing the toner's frictional charging amount to increase to make the toner strongly attach to the carrier surface to form a coat on the carrier, deteriorating the carrier to make the subsequent frictional charging of the toner inadequate, thus lowering the image density, scattering the toner, and so forth.

On the other hand, Japanese Patent O.P.I. Publication No. 140361/1985 has already proposed a developing method which uses a two-component developer whose toner has an weight average particle size of from 5 to 20 $\mu$m, and has such a particle size distribution that the more than double the weight average particle size part and the less than $\frac{1}{3}$ of the weight average particle size part of the toner account for not more than 10% by weight of the whole toner.

According to this developing method, since the particle size distribution of the toner in the developer is limited to the above-mentioned range, the unevenness of the action of the oscillating electric field to the toner is lessened, so that the foregoing selective development phenomenon is improved.

Incidentally, according to our investigation, the selective development phenomenon is connected also with the thickness of the developer layer; the thinner the developer layer, the more significantly does the phenomenon tend to occur. That is, if the layer is thick, this phenomenon does not occur, which is considered due to the fact that the toner particles' mutual restraining action restrains the selective development.

As has been mentioned, in the case of forming a thin two-component developer layer, when the foregoing elastic plate is arranged to press on the sleeve surface, a developer layer as thin as not more than 500 $\mu$m, and preferably not more than 300 $\mu$m can be formed, and so much the higher resolution image can be obtained, but on the other hand, it has been found that the selective development occuring condition becomes so severe that it makes inadequate the developer as described in the foregoing Japanese Patent O.P.I. Publication No. 140361/1985 for its developing method.

SUMMARY OF THE INVENTION

The present invention has been made in view of the above-described circumstances. It is an object of the present invention to provide a method for developing electrostatic latent images in non-contact manner by use of a thin developer layer in an oscillating electric field, said method being capable of repeatedly making satisfactory development many times without bringing about any bias voltage fall due to dielectric breakdown, deterioration in image quality, selective development phenomenon, and the like.

The above object can be accomplished by a developing method in which during the course of transporting to the developing region a two-component developer comprised of toner particles powder and carrier beads powder by a developer transport carrier, the amount of the developer transported is regulated by a thin layer forming member consisting of a planar material arranged so as to elastically press on the said developer transport carrier to thereby form a thin developer layer, and the developer layer is transported, with its surface keeping out of contact with the latent image carrier, to the developing region, and an electrostatic latent image formed on the latent image carrier is then developed by the developer layer, being placed in an oscillating electric field, in which method when the weight average toner particle size of said powdery toner particles is regarded as $D_{50}$, the toner particles having particle sizes in the range of from 1/1.7 to 1.7 times the weight average particle size $D_{50}$ account for not less than 95% by weight of the whole toner particles powder.

In other words, the present invention relates to a method for developing an electrostatic latent image comprising, a step of supplying a developer containing a carrier and a toner, said toner consisting of fine toner particles of which not less than 95% by weight have a particle size of from 1/1.7 to 1.7 times as large as the weight average size of the toner particles ($D_{50}$), to the outer circumfence of of a cylinder-shaped sleeve member of a developer transporting means which comprises said sleeve member and a plurality of magnets provided inside said sleeve member so that said magnets and said sleeve member are so arranged as to be rotatable in relation to each other around the center axis of said sleeve member, a step of forming a thin layer of said developer on the surface of said sleeve member by the use of a layer thickness regulating member so that the maximum thickness of the developer layer is smaller than the minimum distance between the surface of said sleeve member and the surface of said electrostatic latent image carrying member, the layer thickness regulating member being disposed opposite to said developer transforming member, comprising a resilient plate and and being provided so that at least a part of said resilient plate is in pressure contact with said sleeve member, a step of carrying said developer to close proximity of the image carrying member, and a step of forming a toner image on said electrostatic latent image carrying member.

According to the preferred embodiment of the present invention, the weight average particle size $D_{50}$ is from 8 to 16 μm.

According to this invention, development is made by a very uniform and very thin two-component developer layer formed by using a thin layer forming member consisting of a planar material arranged so as to elastically press on the developer transport carrier, and in the toner particles powder constituting the two-component developer of the said developer layer, the toner particles' weight average particle size $D_{50}$ is specified to fall under a range as narrow as 8 to 16 μm, and the toner particles in the size range of 1/1.7 to 1.7 times the foregoing weight average particle size $D_{50}$ account for not less than 95% by weight of the whole toner particles powder, so that changes in the image quality due to dielectric breakdown and occurrence of the selective development phenomenon can be restrained, and satisfactory development can be repeatedly made a number of times.

Namely, a very narrow particle size distribution-having toner particles powder is used, so that the toner particles undergo uniformly the action of an oscillating electric field regardless of the particle size. Accordingly, there occurs no substantial difference in the adherence of the toner to an electrostatic image according to the particle size, and as a result, even when repeating the developing process many times, the particle size distribution of the toner particles inside the developing device is stably retained as in the initial condition.

Therefore, the amount of the toner's frictional charge can be steadily obtained enabling to stably form sufficient density-having images, and moreover, the surface stain of the carrier particles due to small-particle-size toner powder becomes reduced, the durability of the carrier particle is largely improved, and further, scattering of the toner particles is prevented, so that the developing process can be carried out without stain.

Figure 1:
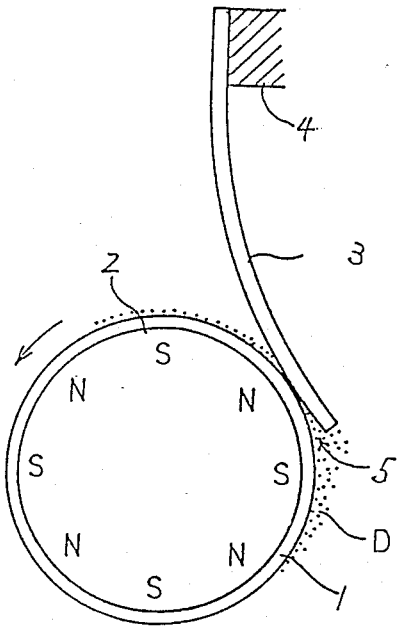
FIG. 1 shows sectional drawings for explaining a thin layer forming member.
Figure 1:
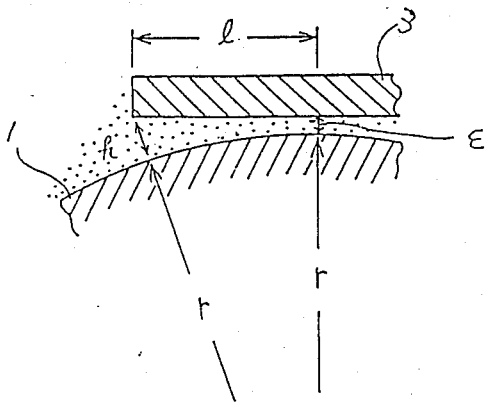

In these drawings, 1 is a developing sleeve, 2 is a magnetic roll, 3 is a thin layer forming member or a layer thickness regulating member (elastic plate), 6 is a latent image carrier, 7 and 8 are stirring members, 11 is a toner T replenishing means, 12 is a toner replenishing roll, 13 is a developer (D) depository, 14 is a bias power supply, and 15 is a developing region.

DETAILED DESCRIPTION OF THE INVENTION

The toner particles powder constituting the two-component developer to be used in this invention is one which, if the weight average particle size of the toner particles of the said toner particles powder is regarded as $D_{50}$, the toner particles having particle sizes in the range of from 1/1.7 to 1.7 times the weight average particle size $D_{50}$ account for not less than 95% by weight of the whole toner particles powder. The weight average particle size $D_{50}$ in the toner particles powder is a value measured by an instrument called 'Coultercounter' (manufactured by Coulter Co.).

If a toner particles powder does not satisfy the above requirement, its particle size distribution is so wide that the selective development phenomenon occurs. Consequently, as the developing process is repeated, smaller-size toner particles become accumulated inside the developing device, thus increasing the amount of the toner's frictional charge to excess, whereby the image density is lowered, the carrier beads' surface is covered with small-particle-size toner particles, the toner's frictional chargeability is obstructed, and weakly charged or uncharged toner particles are scattered to bring about stain.

The weight average particle size $D_{50}$ of the toner particles in the toner particles powder is preferably from 8 to 16 μm. By using such the particle size-having toner particles powder, a high-quality image having a high resolution and excellent in the gradation reproducibility can be formed and the image formation can be carried out with no fogging trouble due to toner scattering.

The method for obtaining a specific particle size distribution-having toner particles powder as mentioned above, although not particularly restricted, is such that, for example, a crude powder obtained by kneading and finely pulverizing a toner material is classified an appropriate number of times to remove those small-diameter-side particles and large-diameter-side particles from the whole powder, whereby objective toner particles can be easily obtained.

A binder resin to be used for the toner is not particularly limited; any conventionally known resin may be used. Examples of the resin include polyester resins, styrene resins, acryl resins, styrene-acryl resins, and the like.

Coloring agents applicable to the toner include carbon black, nigrosine dyes, aniline blue, calco oil blue, chrome yellow, ultramarine blue, DuPont oil red, quinonline yellow, methylene blue chloride, phthalocyanine blue, malachite green oxalate, Lumpblack, Rosebengal, mixtures of some of these materials, and others.

To the toner may, if necessary, be added various additives, such as charge control agents, fixability improving agents, fluidity improving agents, abrasives, and the like. The fluidity improving agent and the abrasive are normally used in the manner of being added from the outside to and mixed with toner particles.

The carrier constituting the two-component developer to be used in this invention are desirable to be comprised substantially of spherical carrier particles, wherein the term 'substantially spherical' implies that the value of the Wadell's practical sphericity w is not less than 0.65. The practical sphericity w is defined by the following formula:

$$\text{Practical sphericity} = \frac{\text{Diameter of a circle equivalent to the projected area of a particle}}{\text{Diameter of the minimum circle circumscribing the projected image of a particle}}$$

The measurement of the projected area of a particle may be carried out by using, e.g., 'PAMIC-8800'.

The use of such the substantially spherical carrier beads-containing carrier powder results in sufficient toner-carrier frictional charging due to its high fluidity, thereby largely reducing the ratio of the carrier to weakly charged toner particles, and thus the toner-carrier electrostatic attraction causes the toner to be steadily retained on the developer carrier to thereby enable to prevent the toner or carrier from scattering, thus leading to prevention of the apparatus from being stained and of fogging trouble. The carrier creates no directivity in magnetization, so that it allows the formation of a thin, uniform thickness-having developer layer on the developer transport carrier, and consequently, due to the action of an oscillating electric field, the toner's adherence to an electrostatic latent image improves. Also, since a bias voltage is uniformly applied to the carrier particles, the applied effect of the bias voltage is sufficiently displayed.

The weight average particle diameter of the carrier is desirable to be not more than 50 μm. The use of such the particle diameter-having carrier makes possible to improve the image resolution as well as the gradation reproducibility. The weight average particle diameter of carrier herein is a value measured by means of a 'Microtrack' (manufactured by Nikkiso Co.).

The resistivity of the carrier is preferably not less than $10_{13}\Omega$.cm. The use of such the highly insulating carrier enables to prevent the occurrence of such phenomena as adherence of the carrier to the latent image carrier's surface as a result of the charge injection by the bias voltage, or vanishment of the charge for forming an electrostatic latent image. The resistivity of the carrier can be found in the following manner: a powder sample is put in a container having a sectional area of, e.g., 0.50 $cm^2$, and, after tapping the container, a load of 1 $kg/cm^2$ is applied onto the sample particles contained to make its thickness about 1 mm, and the sample's resistivity can be found by measuring the value of an electric current which flows when applying an electric field of $10^2$ to $10^5$ V/cm to between the load and the bottom electrode.

The form of the carrier is not particularly limited. To be concrete, any of non-coated-type carrier, coated-type carrier beads powder, magnetic material-dispersed-type carrier, and the like, may be used.

The magnetic material to constitute the carrier can be any material without limitation as long as it is one strongly magnetizable by a magnetic field in its direction. Examples of such the material include ferromagnetic metals such as iron, nickel, cobalt, etc.; alloys containing these metals; ferromagnetic metal compounds such as ferrite, magnetite, etc.; alloys which do not contain any ferromagnetic elements but come to display ferromagneticity when subjected to appropriate thermal treatment, and which include those alloys called 'Heusler alloys' such as, e.g., manganese-copper-aluminum, manganese-copper-tin, etc., and chromium dioxide, and the like.

The term 'ferrite' herein is a general term for all magnetic oxides containing iron but not restricted to only those spinel-type ferrites which are represented by the formula: $MO.Fe_2O_3$ (bivalent metals). By varying the ferrite's metal component composition, various magnetic characteristics can be obtained; particularly, a highly insulating carrier capable of exhibiting sufficient bias voltage application effect can be easily obtained.

Resins applicable to the coated-type carrier or magnetic material-dispersed-type carrier, although not particularly restricted, include styrene-type resins, acryl-type resins, styrene-acryl-type resins, vinyl-type resins, rosin denatured resins, polyamide resins, polyester resins, and the like.

The mixing ratio of the toner and the carrier is desirable to be determined so that about 5 to 30% of the surface of the carrier can be covered with the toner. This mixing ratio range is suitable for displaying even better developability by the action of an oscillating electric field.

In this invention, a developer layer comprised of the above-mentioned two-component developer is formed on the developing sleeve, this developer layer is transported, with its layer surface not contacted with the latent image carrier, to the developing region, and this developer layer, while being placed in an oscillating electric field, develops an electrostatic latent image on the electrostatic latent image carrier.

The foregoing oscillating electric field is from 500 to 7000 V/mm; the AC voltage (peak-to-peak value) required to form the oscillating electric field is about 0.5 to 5 kV; the voltage not to cause any leak discharge, dielectric breakdown, etc., is preferably about 1 to 3 kV: and an AC bias voltage of a frequency of from about 1 to 5 kHz may be used. This oscillating electric field is desirable to be formed between the developing sleeve and the latent image carrier, and particularly desired to be formed in the minimum gap (hereinafter may also be called 'developing gap') between the developing sleeve and the latent image carrier. Besides the above AC bias voltage, if necessary, a DC bias voltage may also be applied to the developing gap.

As the developing sleeve for use in transporting the developer layer to the developing region, although not particularly restricted, those similar in the construction to conventional, bias voltage-applicable ones may be used. The developing sleeve has thereinside a magnetic roll which comprises a plurality of alternately arranged N and S magnetic poles and which is fixed or rotatable either in the same direction as that of the sleeve or in the inverse direction. To be more concrete, as the magnetic roll, one having from 8 to 32 magnetic poles may be used, and when this is revolved, a fluctuating magnetic field can be formed on the developing sleeve.

Since the developer layer on the developing sleeve needs to be transported, with its surface not contacted with the latent image carrier, to the developing region, it is essential for the thickness of the layer to be smaller than the developing gap. To be concrete, the developer layer is desirable to be of a layer as thin as not more than 500 μm, and preferably from 10 to 300 μm. The developing gap needs to be larger than the thickness of the developing layer, but is preferred to be as much small as possible; preferably not more than 1000 μm, more preferably in the range of from 100 to 500 μm.

Where the developer layer is a so thin layer, the developing gap can be made so sufficiently small as to lower the voltage necessary for the formation of an oscillating electric field required for flying the toner in the developing region. Even the thus relatively low voltage is enough to form an adequate oscillating electric field, so it is advantageous also in respect that the toner scattering can be lessened, and at the same time, the occurrence of leak discharge from the developing sleeve can be prevented. Further, where the developing gap is so small, the electrostatic latent image formed on the latent image carrier causes the intensity of the electric field to be formed in the developing region to increase, thus making possible to develop satisfactorily even delicate changes in the gradation or fine pattern.

In order to make the developer layer a thin layer and yet to transport a sufficient amount of the toner to the developing region, it is desirable that the number of revolutions of the developing sleeve and, if necessary, the magnetic roll, be increased. However, in order to perform a non-directional, satisfactory development, the linear speed of the developing sleeve is desirable to be within ten times the linear speed of the latent image carrier.

As a meas for the formation of a thin developer layer on the developing sleeve, the 'thin layer forming member arranged so as to elastically press on the surface of a developing sleeve' as described in the foregoing Japanese Patent O.P.I. Publication No. 52566/1987 may be used. In addition, the thickness of the developer layer can be found by using a device 'Nikon Profile Projector' (manufactured by Nippon Kogaku Kogyo K.K.) and in comparison between the image of the developing sleeve projected onto a screen and the image of the developing sleeve with a developer layer formed thereon projected onto the screen.

The present invention will be illustrated in detail by the following examples, but the invention is not limited thereto.

EXAMPLE 1

Preparation of Toners (1) Toner 1 (for the invention)

One hundred parts by weight of a polyester resin 'UXK 120P' (product of Kao Co.), 6 parts by weight of polypropylene 'Viscol 660P' (product of Sanyo Chemical Industry Co.) and 10 parts by weight of carbon black 'Mogal L'(product of Cabot Co.) were mixed and then kneaded, cooled, roughly pulverized, further finely pulverized, and then classified, whereby a toner particles powder having the particle size distribution given in Table 1 was obtained. This was regarded as Toner 1.

(2) Toners 2 through 16 (for the invention)

Toners were prepared in the same manner as in Toner 1 except that the classification condition was varied, whereby 15 toner particles powders having different particle size distributions as shown in Table 1 were obtained. These were regarded as Toner 2 through Toner 16, respectively.

(3) Toners 17 through 32 (comparative)

Sixteen different toner powders were obtained as given in Table 1 by preparing in the same manner as in Toner 1 except that the classification condition was further varied otherwise. These were regarded as Toner 17 through Toner 32, respectively.

Preparation of Toner Carriers (1) Carrier 1

The surface of ferrite particles (particle distribution range=5 to 60 μm, weight average particle size=49 μm) was coated with a methyl methacrylate-styrene copolymer resin (monomers ratio 6/4), whereby a coated-type carrier was obtained. This was regarded as Carrier 1.

This Carrier 1 had a weight average bead diameter of 50 μm, a practical sphericity w of 0.9 and a resistivity of $10^{13}\Omega$.cm.

Preparation of Developers

The above-prepared Toners 1 through 32 each was combined with Carrier 1 to thereby prepare 10% by weight toner concentration-having developers which were regarded as Developers 1 through 32 corresponding to Toners 1 through 32, respectively.

Practical Copying Tests

Figure 2:
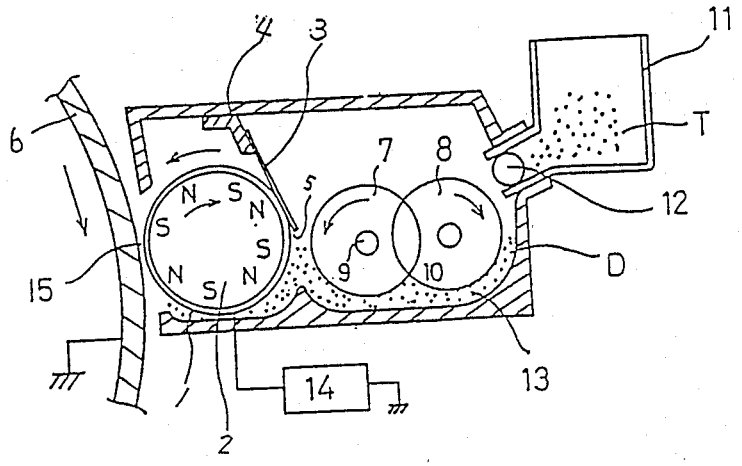
FIG. 2 is a sectional view of a developing device for use in the developing method in an example of this invention.

These developers and a developing device as shown in FIG. 2 were used and the developing process were carried out in accordance with the developing condition that is hereinafter described.

In the developing device of FIG. 2, the same symbols are applied to the same portions as those of FIG. 1, wherein 3 is the thin layer forming member as shown in FIG. 1, 6 is a latent image carrier that revolves in the direction of arrow, 7 is a first stirring member and 8 is a second stirring member. And 9 and 10 are the revolving axes of the above stirring members 7 and 8, respectively, and 11 is a toner replenishing container, 12 is a toner replenishing roll, 13 is a developer depository, 14 is a bias power supply, 15 is a developing region, and T represents toner.

The developing operation of the developing device having the above-mentioned construction in FIG. 2 is as follows:

The developer D inside developer depository 13 is sufficiently mixed and stirred by the first stirring member 7 revolving in the direction of arrow and the second stirring member 8 revolving in the reverse direction overlappingly with the first stirring member 7, and is made adhere to the surface of developing sleeve 1 and transported by the transporting force of developing sleeve 1 revolving in the direction of arrow and magnetic roll 2 revolving counter thereto. The surface of developing sleeve 1 is pressed on by a part near the tip end of the foregoing thin layer forming member 3 held by a fixing member 4 extending from the housing, which member regulates the thickness of developer D that is transported as mentioned above. This developer layer, at the developing region 14, develops, in non-contact manner at an interval of the gap, the latent image on latent image carrier 6 which revolves in the direction of arrow, thereby forming a toner image.

At the time of the development, from power supply 14 a developing bias voltage containing both DC component and AC component on almost the same level as that of the electric potential in the non-exposed portion of the latent image carrier is applied to developing sleeve 1, and as a result, only the toner in the developer on developing sleeve 1 is selectively transferred onto and adheres to the plane of the foregoing latent image. In this instance, the measurement of the thickness of the developer layer was performed by the aforementioned method using the Nikon Profile Projector, manufactured by Nippon Kogaku Kogyo K.K.

Developing Conditions (Reversal Development)

Latent image carrier 6

A 140 mm diameter-having drum-type photoreceptor having an organic photoconductive photosensitive layer: A linear speed of 60 mm/s, non-image area's surface potential of −700 V, and image area's surface potential of −50 V.

Developing sleeve 1

A 20 mm diameter-having cylindrical sleeve: Its circumferentially moving direction was made the same at the developing gap as that of latent image carrier 6. A linear speed of 250 mm/s.

Magnetic roll 2

Having 8 magnetic poles and a revolving speed of 1000 rpm. Its revolving direction is counter to that of the developing sleeve.

Thin layer forming member 3

A 0.3 mm-thick elastic plate made of phosphor bronze, arranged so as to elastically press on the surface of the developing sleeve.

Developing gap

400 μm

Thickness of developer layer

300 μm (maximum)

DC bias voltage

−500 to −600 V DC voltaghe was applied to developing sleeve 1.

Oscillating electric field

An AC voltage having a frequency of 3 kHz and voltage (peak-to-peak value) of 2.0 kVp-p was applied to developing sleeve 1, and latent image carrier 6 was leveled with ground potential.

Under the above conditions, the 32 developer samples from No. 1 through No. 32 were used in turn, and copying operation was continually repeated 10,000 times per each developer, and the presence of selective development phenomenon at each of the stages of obtaining the 1000th copy, 2500th copy, 5000th copy, 7500th copy and 10,000th copy was checked paying attention to the degree of image density decline and toner scattering. Also, the image quality of the 10,000th copy obtained when each developer for this invention was used was evaluated with respect to the gradation and resolution, and rated 'A' for excellent, 'B' for somewhat poor, and 'C' for inferior. The results are as shown in Table 2.

TABLE 1

| | Characteristics | | | | | |
|---|---|---|---|---|---|---|
| Toner No. | $D_{50}$ (μm) | $D_{50} \times 1/1.7$ (μm) | $D_{50} \times 1.7$ (μm) | Ratio of less than $D_{50} \times 1/1.7$ particles (% by wt) | Ratio of more than $D_{50} \times 1.7$ particles (% by wt) | Ratio of $D_{50} \times 1/1.7$ to $D_{50} \times 1.7$ particles (% by wt) |
| 1 | 5.0 | 2.9 | 8.5 | 2.3 | 2.2 | 95.5 |
| 2 | 5.0 | 2.9 | 8.5 | 1.4 | 1.9 | 97.3 |
| 3 | 7.6 | 4.5 | 12.9 | 2.2 | 1.8 | 96.0 |
| This 4 | 7.6 | 4.5 | 12.9 | 1.0 | 0.8 | 98.2 |
| Inven- 5 | 8.3 | 4.9 | 14.1 | 2.0 | 1.9 | 96.1 |
| tion 6 | 8.3 | 4.9 | 14.1 | 1.2 | 1.1 | 97.7 |
| 7 | 10.5 | 6.2 | 17.9 | 2.5 | 2.4 | 95.1 |
| 8 | 10.5 | 6.2 | 17.9 | 1.0 | 1.0 | 98.0 |
| 9 | 13.0 | 7.6 | 22.1 | 2.0 | 2.1 | 95.9 |
| 10 | 13.0 | 7.6 | 22.1 | 1.1 | 1.1 | 97.8 |
| 11 | 15.8 | 9.3 | 26.9 | 2.2 | 2.3 | 95.5 |
| 12 | 15.8 | 9.3 | 26.9 | 0.8 | 0.9 | 98.3 |
| 13 | 16.2 | 9.5 | 27.5 | 2.2 | 2.4 | 95.4 |
| 14 | 16.2 | 9.5 | 27.5 | 0.8 | 1.1 | 98.1 |

TABLE 1-continued

| Toner No. | Characteristics | | | | | |
|---|---|---|---|---|---|---|
| | $D_{50}$ (μm) | $D_{50} \times 1/1.7$ (μm) | $D_{50} \times 1.7$ (μm) | Ratio of less than $D_{50} \times 1/1.7$ particles (% by wt) | Ratio of more than $D_{50} \times 1.7$ particles (% by wt) | Ratio of $D_{50} \times 1/1.7$ to $D_{50} \times 1.7$ particles (% by wt) |
| 15 | 20.0 | 11.8 | 34.0 | 2.3 | 2.6 | 95.1 |
| 16 | 20.0 | 11.8 | 34.0 | 1.2 | 1.1 | 97.2 |
| 17 | 5.2 | 3.1 | 8.8 | 2.8 | 2.5 | 94.7 |
| 18 | 5.2 | 3.1 | 8.8 | 4.0 | 4.5 | 91.5 |
| 19 | 7.8 | 4.6 | 13.3 | 2.8 | 2.6 | 94.6 |
| Compa- 20 | 7.8 | 4.6 | 13.3 | 5.0 | 4.8 | 90.2 |
| rative 21 | 8.1 | 4.8 | 13.8 | 3.2 | 2.8 | 94.0 |
| Exam- 22 | 8.1 | 4.8 | 13.8 | 3.7 | 3.8 | 92.5 |
| ple 23 | 10.3 | 6.1 | 17.5 | 2.5 | 2.4 | 94.1 |
| 24 | 10.3 | 6.1 | 17.5 | 4.3 | 4.3 | 91.4 |
| 25 | 12.9 | 7.6 | 21.9 | 2.8 | 2.9 | 94.3 |
| 26 | 12.9 | 7.6 | 21.9 | 4.8 | 4.9 | 90.3 |
| 27 | 15.6 | 9.2 | 26.5 | 3.0 | 3.1 | 93.9 |
| 28 | 15.6 | 9.2 | 26.5 | 5.0 | 5.2 | 89.8 |
| 29 | 16.3 | 9.6 | 27.7 | 3.0 | 3.2 | 93.8 |
| 30 | 16.3 | 9.6 | 27.7 | 4.2 | 4.5 | 91.3 |
| 31 | 21.0 | 12.4 | 35.7 | 2.8 | 3.0 | 94.4 |
| 32 | 21.0 | 12.4 | 35.7 | 4.3 | 4.7 | 91.0 |

TABLE 2

| Toner No. | Characteristics | | | | | | | |
|---|---|---|---|---|---|---|---|---|
| | $D_{50}$ (μm) | Ratio of $D_{50} \times 1/1.7$ to $D_{50} \times 1.7$ particles (% by wt) | 1000th | 2500th | 5000th | 7500th | 10000th | Final image quality (gradation, resolution) |
| 1 | 5.0 | 95.5 | | | | | DD | B |
| 2 | 5.0 | 97.3 | | | | | " | B |
| 3 | 7.6 | 96.0 | | | | | " | B |
| 4 | 7.6 | 98.2 | | | | | " | B |
| This 5 | 8.3 | 96.1 | | | | | with- | |
| Inven- | | | | | | | out SD | A |
| tion 6 | 8.3 | 97.7 | | | | | " | A |
| 7 | 10.5 | 95.1 | | | | | " | A |
| 8 | 10.5 | 98.0 | | | | | " | A |
| 9 | 13.0 | 95.9 | | | | | " | A |
| 10 | 13.0 | 97.8 | | | | | " | A |
| 11 | 15.8 | 95.5 | | | | | " | A |
| 12 | 15.8 | 98.3 | | | | | " | A |
| 13 | 16.2 | 95.4 | | | | | " | B |
| 14 | 16.2 | 98.1 | | | | | " | B |
| 15 | 20.0 | 95.1 | | | | | " | C |
| 16 | 20.0 | 97.2 | | | | | " | C |
| 17 | 5.2 | 94.7 | DD, TS | | | — | — | — |
| 18 | 5.2 | 91.5 | " | | | — | — | — |
| 19 | 7.8 | 94.6 | DD | TS | | — | — | — |
| Compa- 20 | 7.8 | 90.2 | DD, TS | | | — | — | — |
| rative 21 | 8.1 | 94.0 | | DD, TS | | — | — | — |
| Exam- 22 | 8.1 | 92.5 | | " | | — | — | — |
| ple 23 | 10.3 | 94.1 | | " | | — | — | — |
| 24 | 10.3 | 91.4 | | " | | — | — | — |
| 25 | 12.9 | 94.3 | | " | | — | — | — |
| 26 | 12.9 | 90.3 | | " | | — | — | — |
| 27 | 15.6 | 93.9 | | " | | — | — | — |
| 28 | 15.6 | 89.8 | | " | | — | — | — |
| 29 | 16.3 | 93.8 | | DD | TS | — | — | — |
| 30 | 16.3 | 91.3 | | " | " | — | — | — |
| 31 | 21.0 | 94.4 | | " | " | — | — | — |
| 32 | 21.0 | 91.0 | | " | " | — | — | — |

Note:
DD . . . Density Decrease
TS . . . Toner Scattering
SD . . . Selective Development As is apparent from Table 2, unlike the comparative samples, the samples for this invention bring about no selective development phenomenon which is to appear at the time of image density decline, toner scattering, etc., and thus the invention is suitable for repetitive image forming operation or a large number of copies making operation. Also, it is understood that in respect of image quality, the weight average particle size range of from 8 to 16 μm is particularly excellent.

What is claimed is:

1. A method for developing an electrostatic image, said method comprising, supplying a developer containing a carrier and a toner, said toner consisting of fine toner particles of which not less than 95 percent by weight have a particle size of from 1/1.7 to 1.7 times that of the weight average size of the toner particles, to the outer circumference of a cylinder-shaped sleeve member of a developer transporting means which comprises said sleeve member and a plurality of magnets provided inside said sleeve member, the magnetic poles and said sleeve member being so arranged as to be rotatable in relation to each other, around the center axis of said sleeve member, forming a thin layer of said developer on the surface of said sleeve member by the use of a layer thickness regulating member, said layer thickness regulating member being disposed opposite to said developer transporting means and comprising a resilient plate, at least a part of said resilient plate being in pressure contact with said sleeve member, the thickness of the developer layer being less than the minimum distance between the surface of said sleeve member and the surface of an electrostatic latent image carrying member, carrying said developer in close proximity to the image carrying member, an oscillating electric field being applied between said electrostatic image carrying member and said developer transporting means, and forming a toner image on said electrostatic latent image carrying member.

2. The method of claim 1, wherein the weight average particle size of the toner ($D_{50}$) is 8 μm to 16 μm.

3. The method of claim 1 wherein the minimum distance between the surface of said sleeve member and the surface of said electrostatic latent image carrying member is less than 1 mm.

4. The method of claim 3, wherein the minimum distance between the surface of said sleeve member and the surface of said electrostatic latent image carrying member is less than 0.5 mm.

5. The method of claim 1, wherein the minimum distance between the surface of said sleeve member and the thickness of the developer layer is less than 500 μm.

6. The method of claim 5, wherein the minimum distance between the surface of said sleeve member and the thickness of the developer layer is less than 300 μm.

7. The method of claim 1, wherein the oscillating electric field applied between said electrostatic image carrying member and said developer transporting means is 500 to 10,000 V/mm.

8. The method of claim 1, wherein said carrier consists essentially of particles having a spherical shape.

9. The method of claim 1, wherein the weight average particle size of the carrier is not more than 50 μm.

10. The method of claim 1, wherein the specific resistance of the carrier is not less than $10^{13}$ ohm.cm.

* * * * *